US010822138B1

(12) United States Patent
Voorhees

(10) Patent No.: US 10,822,138 B1
(45) Date of Patent: Nov. 3, 2020

(54) PACKAGING ASSEMBLY WITH CORRUGATED CORNER ELEMENTS

(71) Applicant: Rational Packaging LLC, Dandridge, TN (US)

(72) Inventor: Samuel C. Voorhees, Louisville, KY (US)

(73) Assignee: Rational Packaging LLC, Dandridge, TN (US)

( * ) Notice: Subject to any disclaimer, the term of this patent is extended or adjusted under 35 U.S.C. 154(b) by 92 days.

(21) Appl. No.: 15/964,439

(22) Filed: Apr. 27, 2018

(51) Int. Cl.

| | |
|---|---|
| ***B65D 81/05*** | (2006.01) |
| ***B65D 5/50*** | (2006.01) |
| ***B65D 90/00*** | (2006.01) |
| ***B65D 5/00*** | (2006.01) |

(52) U.S. Cl.
CPC ..... *B65D 5/5033* (2013.01); *B65D 5/002* (2013.01); *B65D 81/053* (2013.01); *B65D 81/054* (2013.01); *B65D 90/0026* (2013.01); *B65D 2581/053* (2013.01)

(58) Field of Classification Search
CPC .. B65D 5/5033; B65D 5/002; B65D 90/0026; B65D 81/053; B65D 81/054; B65D 81/055; B65D 2581/053
USPC ..... 206/586, 453, 521
See application file for complete search history.

(56) References Cited

U.S. PATENT DOCUMENTS 3,244,347 A 4/1966 Jenk
3,891,086 A * 6/1975 Isaacs ..... B65D 57/00 206/320
4,050,604 A * 9/1977 Flanders ..... B65D 7/24 220/4.28
4,125,187 A * 11/1978 Vecchiotti ..... H01M 2/0237 206/521
4,244,471 A * 1/1981 Plante ..... B65D 19/0018 206/386
4,771,893 A 9/1988 Liebel
5,131,541 A 7/1992 Liebel
5,267,651 A * 12/1993 Hughes ..... B65D 5/5033 206/453
5,277,310 A * 1/1994 Mertz ..... B65D 5/5028 206/320
5,593,039 A 1/1997 Ortlieb
6,059,104 A 5/2000 Widman
6,186,329 B1 2/2001 Qiu
6,234,314 B1 5/2001 Qiu et al.
(Continued)

*Primary Examiner* — Steven A. Reynolds
(74) *Attorney, Agent, or Firm* — Shaddock Law Group, PC

(57) ABSTRACT

A packaging assembly, including corrugated corner elements, each corrugated corner element having a first corner post element leg, extending from a vertex of the corrugated corner element and having one or more alternating ridges and grooves, and a second corner post element leg, extending from the vertex, away from the first corner post element leg, and having one or more alternating ridges and grooves; and at least two endcap elements, each comprising at least one tray layer attached or coupled to at least one support layer, wherein the tray layer extends to four corners and the support layer includes a corner recess formed proximate each corner of the tray layer, wherein each corner recess is formed so as to mateingly engage at least a portion of the first end portion or the second end portion of one of the corrugated corner elements at least partially therein.

20 Claims, 8 Drawing Sheets

(56) References Cited

U.S. PATENT DOCUMENTS

| | | | | |
|---|---|---|---|---|
| 6,357,587 | B1 * | 3/2002 | Melms, Jr. | B65D 85/64 206/320 |
| 6,513,662 | B1 | 2/2003 | Stebelton | |
| 6,527,119 | B1 * | 3/2003 | Markert | B65D 81/054 206/453 |
| 7,048,118 | B2 * | 5/2006 | Baechle | B65D 61/00 206/320 |
| 7,128,214 | B2 | 10/2006 | Qiu et al. | |
| 7,137,517 | B2 | 11/2006 | Lowry et al. | |
| 8,079,476 | B2 * | 12/2011 | Simms | B65D 81/054 206/453 |
| 2005/0092633 | A1 * | 5/2005 | Baechle | B65D 61/00 206/320 |
| 2008/0237419 | A1 | 10/2008 | Baechle | |

* cited by examiner

PACKAGING ASSEMBLY WITH CORRUGATED CORNER ELEMENTS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging assemblies. More specifically, the present disclosure relates to a packaging assembly with corrugated corner elements.

2. Description of Related Art

It is generally known to use various packaging assemblies to package products for storage or shipping. Typically, packaging assemblies are constructed so as to stabilize the contained item or items and provide a certain degree of cushioning against breakage, while being moved or transported.

Depending on the size, shape, and/or weight of the contained item or items, packaging assemblies may be placed atop one another or pallets for storage, shipping, or transportation.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging assemblies have various shortcomings. Among other things, known packaging assemblies are cumbersome and often require that the packaging assemblies be wrapped or placed within a larger box or container in order for the components of the packaging assemblies to remain in their desired position or orientation.

In various exemplary, non-limiting embodiments, the packaging assembly of the present disclosure comprises corrugated corner elements, each corrugated corner element having a first corner post element leg, extending from a vertex of the corrugated corner element and having one or more alternating ridges and grooves, and a second corner post element leg, extending from the vertex, away from the first corner post element leg, and having one or more alternating ridges and grooves; and at least two endcap elements, each comprising at least one tray layer attached or coupled to at least one support layer, wherein the tray layer extends to four corners and the support layer includes a corner recess formed proximate each corner of the tray layer, wherein each corner recess is formed so as to mateingly engage at least a portion of the first end portion or the second end portion of one of the corrugated corner elements at least partially therein.

In various other exemplary, non-limiting embodiments, the packaging assembly comprises one or more corrugated corner elements, each of the corrugated corner elements extending continuously, along a longitudinal axis, from a first end portion to a second end portion, a vertex of each of the corrugated corner elements extending along the longitudinal axis; each of the corrugated corner elements having a first corner post element leg, extending laterally from the vertex, the first corner post element leg having one or more alternating ridges and grooves, each of the alternating ridges and grooves of the first corner post element leg extending along the longitudinal axis of each of the corrugated corner elements; each of the corrugated corner elements having a second corner post element leg, extending laterally from the vertex and away from the first corner post element leg, the second corner post element leg having one or more alternating ridges and grooves, each of the alternating ridges and grooves of the second corner post element leg extending along the longitudinal axis of each of the corrugated corner elements; and at least two spaced endcap elements, wherein each endcap element comprises at least one tray layer attached or coupled to at least one support layer, wherein the at least one tray layer extends to four corners and wherein the at least one support layer includes a corner recess formed proximate each corner of the at least one tray layer, wherein each corner recess is formed so as to mateingly engage at least a portion of the first end portion or the second end portion of one of the corrugated corner elements at least partially therein.

In certain exemplary, non-limiting embodiments, the vertex bisects each of the corrugated corner elements, along the longitudinal axis, proximate a center of each of the corrugated corner elements.

In certain exemplary, non-limiting embodiments, the outer wall of each of the corrugated corner elements is substantially coextensive with the inner wall of each of the corrugated corner elements.

In certain exemplary, non-limiting embodiments, each of the alternating ridges and grooves of the first corner post element leg are parallel and alternating ridges and grooves.

In certain exemplary, non-limiting embodiments, each of the alternating ridges and grooves of the second corner post element leg are parallel and alternating ridges and grooves.

In certain exemplary, non-limiting embodiments, each of the first corner post element legs and each of the second corner post element legs is curvilinear along a length.

In certain exemplary, non-limiting embodiments, an inner wall of each of the first corner post element legs and an inner wall of each of the second corner post element legs comprises a sinusoidal succession of waves or curves.

In certain exemplary, non-limiting embodiments, a transverse cross-section of each of the first corner post element legs forms a mirror image of a transverse cross-section of each of the second corner post element legs.

In certain exemplary, non-limiting embodiments, each corner recess is formed so as to substantially abut the inner wall of at least a first end portion or a second end portion of each of the corrugated corner elements.

In certain exemplary, non-limiting embodiments, each corner recess forms a parallel curve or offset curve of the inner wall of at least a first end portion or a second end portion of each of the corrugated corner elements.

In certain exemplary, non-limiting embodiments, each corner recess forms a mating surface for the inner wall of at least a first end portion or a second end portion of each of the corrugated corner elements.

In various other exemplary, non-limiting embodiments, the packaging assembly comprises four corrugated corner elements, each of the corrugated corner elements having an outer wall and an opposing inner wall, each of the corrugated corner elements extending lengthwise, along a longitudinal axis, continuously from a first end portion to a second end portion, each of the corrugated corner elements having a first corner post element leg, the first corner post element leg having one or more alternating ridges and grooves, each of the alternating ridges and grooves extending along the longitudinal axis of each of the corrugated corner elements; each of the corrugated corner elements having a second corner post element leg, the second corner post element leg having one or more alternating ridges and grooves, each of the alternating ridges and grooves extending along the longitudinal axis of each of the corrugated corner elements, the first corner post element leg and the second corner post element leg each extending laterally from a vertex, the vertex extending along the longitudinal axis of each of the corrugated corner elements; and two spaced endcap elements, wherein each endcap element comprises at least one tray layer attached or coupled to at least one support layer, wherein the at least one tray layer extends to four corners and wherein the at least one support layer includes a corner recess formed proximate each corner of the at least one tray layer, wherein each corner recess is formed so as to mateingly engage at least a portion of the first end portion or the second end portion of one of the corrugated corner elements at least partially therein.

In various other exemplary, non-limiting embodiments, the packaging assembly comprises one or more corrugated corner elements, each of the corrugated corner elements extending continuously, along a longitudinal axis, from a first end portion to a second end portion, a vertex of each of the corrugated corner elements extending along the longitudinal axis; each of the corrugated corner elements having a first corner post element leg, extending laterally from the vertex, the first corner post element leg having one or more alternating ridges and grooves, each of the alternating ridges and grooves of the first corner post element leg extending along the longitudinal axis of each of the corrugated corner elements; each of the corrugated corner elements having a second corner post element leg, extending laterally from the vertex and away from the first corner post element leg, the second corner post element leg having one or more alternating ridges and grooves, each of the alternating ridges and grooves of the second corner post element leg extending along the longitudinal axis of each of the corrugated corner elements; and two vertically spaced endcap elements, wherein each endcap element comprises a tray layer attached or coupled to a support layer, wherein the tray layer extends to four corners and wherein the support layer includes a corner recess formed proximate each corner of the tray layer, wherein each corner recess is formed so as to mateingly engage at least a portion of the first end portion or the second end portion of one of the corrugated corner elements at least partially therein.

Accordingly, the present disclosure provides a packaging assembly with corrugated corner elements that can be easily stored in a relatively compact configuration, awaiting assembly and use.

The present disclosure separately provides a packaging assembly with corrugated corner elements that can be easily assembled or constructed, when needed.

The present disclosure separately provides a packaging assembly with corrugated corner elements that provides lower costs for handling and storage.

The present disclosure separately provides a packaging assembly with corrugated corner elements with a high degree of compressional strength.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
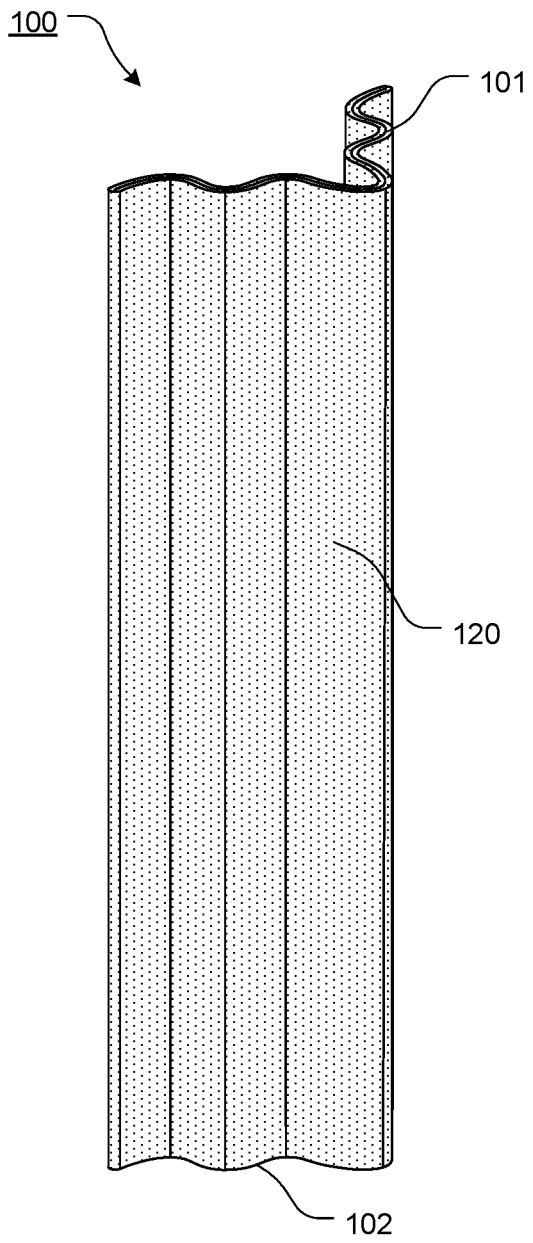
FIG. 1 illustrates a front perspective view of an exemplary embodiment of a corrugated corner element, according to the present disclosure.
Figure 2:
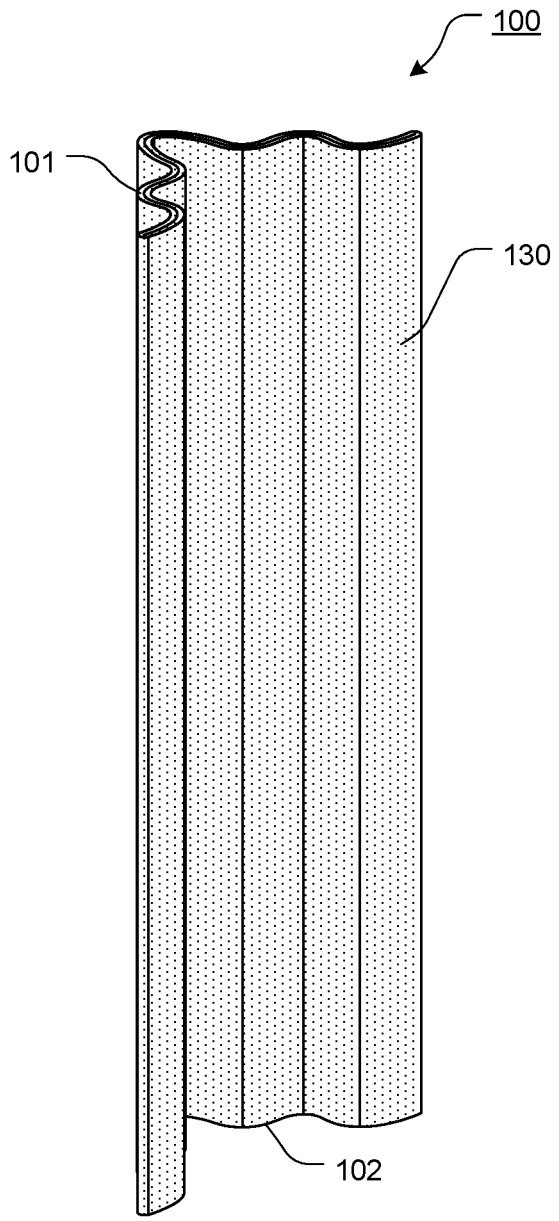
FIG. 2 illustrates a rear perspective view of an exemplary embodiment of a corrugated corner element, according to the present disclosure.
Figure 3:
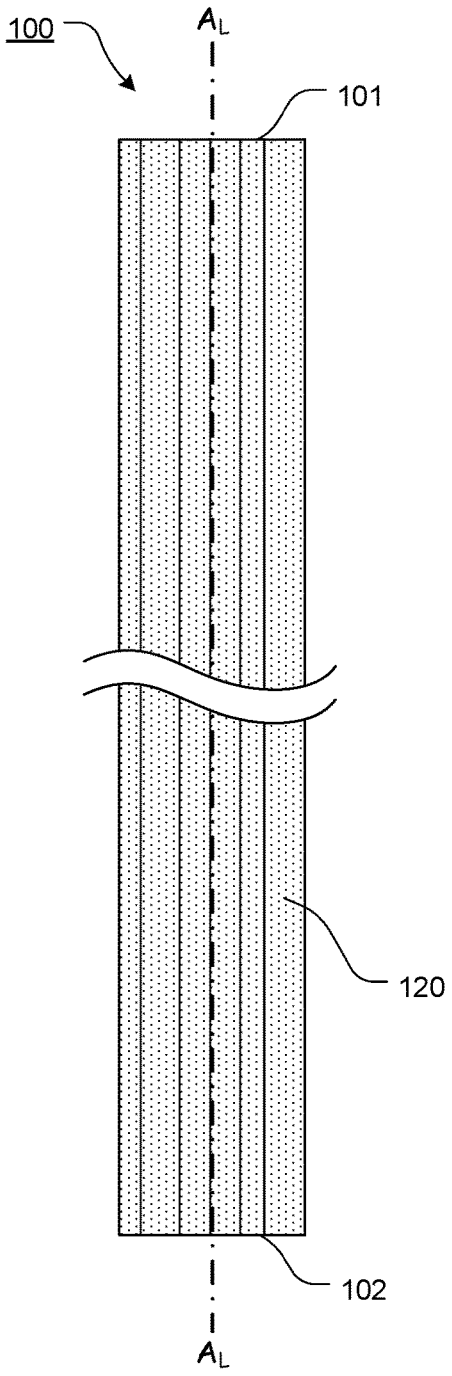
FIG. 3 illustrates a right side view of an exemplary embodiment of a corrugated corner element, according to the present disclosure, the left side view of the exemplary embodiment of the corrugated corner element is a mirror image of the right side view.

For simplicity and clarification, the design factors and operating principles of the packaging assembly with corrugated corner elements are explained with reference to various exemplary embodiments of a packaging assembly with corrugated corner elements according to the present disclosure. The basic explanation of the design factors and operating principles of the packaging assembly with corrugated corner elements is applicable for the understanding, design, and operation of the packaging assembly with corrugated corner elements of the present disclosure. It should be appreciated that the packaging assembly with corrugated corner elements can be adapted to many applications where a packaging assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "packaging assembly" and "corrugated corner element" are used for basic explanation and understanding of the operation of the systems, methods, and apparatuses of the present disclosure. Therefore, the terms "packaging assembly" and "corrugated corner element" are not to be construed as limiting the systems, methods, and apparatuses of the present disclosure.

Turning now to the appended drawing figures, FIGS. 1-14 illustrate certain elements and/or aspects of an exemplary embodiment of the packaging assembly 300 with corrugated corner elements 100, according to the present disclosure. In illustrative, non-limiting embodiment(s) of the present disclosure, as illustrated in FIGS. 1-14, the packaging assembly 300 comprises a plurality of corrugated corner elements 100 and typically two tray or endcap elements 200.

As illustrated most clearly in FIGS. 1-5, the corrugated corner element 100 comprises an elongate portion of material that extends, along a longitudinal axis, $A_L$, from a first end portion 101 to a second end portion 102. In various exemplary embodiments, the corrugated corner element 100 extends continuously, in an uninterrupted manner, from the first end portion 101 to the second end portion 102. Alternatively, one or more notches or recesses may optionally be formed in one or more areas, along the corrugated corner element 100, between the first and 101 and the second end portion 102.

A vertex 122 is defined along the corrugated corner elements 100. The vertex 122 generally extends, along the longitudinal axis, $A_L$, from the first end portion 101 to the second end portion 102. The vertex 122 defines a line from which the first corner post element leg 110 and the second corner post element leg 125 extend. In certain exemplary, non-limiting embodiments, the vertex 122 bisects the corrugated corner elements 100, along the longitudinal axis, $A_L$, proximate a center of each of the corrugated corner elements 100. Generally, the vertex 22 defines the furthest extent of the corrugated corner post element 100.

The first corner post element leg 110 extends laterally from the vertex 122 to a first corner post element end 128, while the second corner post element leg 112 extends laterally from the vertex 122 to a second corner post element end 129. The second corner post element end 129 extends laterally from the vertex 122, in a direction that is generally away from the direction that the first corner post element end 128 extends laterally from the vertex 122.

In certain exemplary, nonlimiting embodiments, substantially straight lines from the vertex 122 to the respective first corner post element end 128 and from the vertex 122 to the second corner post element end 129 are at approximately 90° relative to one another.

Figure 4:
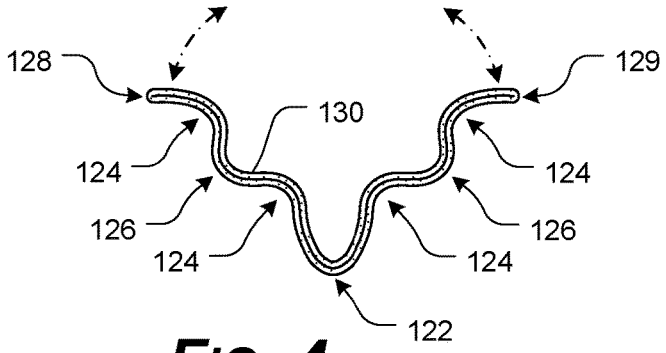
FIG. 4 illustrates a top view of an exemplary embodiment of a corrugated corner element, according to the present disclosure.
Figure 5:
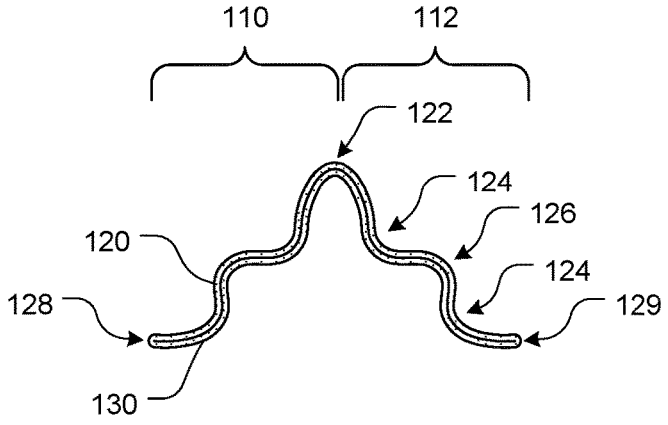
FIG. 5 illustrates a bottom view of an exemplary embodiment of a corrugated corner element, according to the present disclosure.
Figure 6:
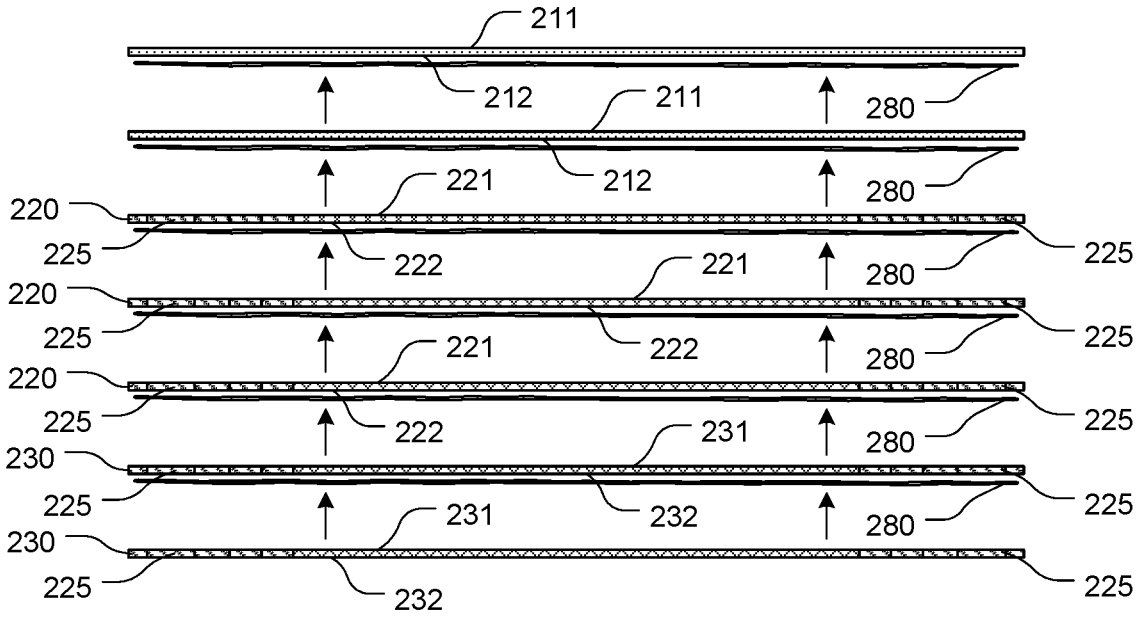
FIG. 6 illustrates a front, exploded, assembly view of an exemplary embodiment of a tray or endcap element, according to the present disclosure.
Figure 7:
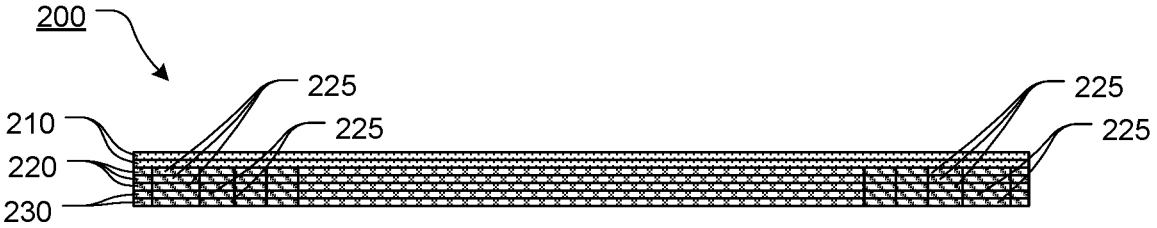
FIG. 7 illustrates a front view of an exemplary embodiment of a tray or endcap element, according to the present disclosure.
Figure 8:
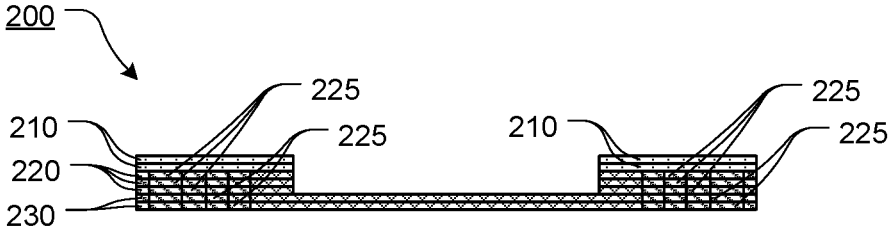
FIG. 8 illustrates a side view of an exemplary embodiment of a tray or endcap element, according to the present disclosure.
Figure 9:
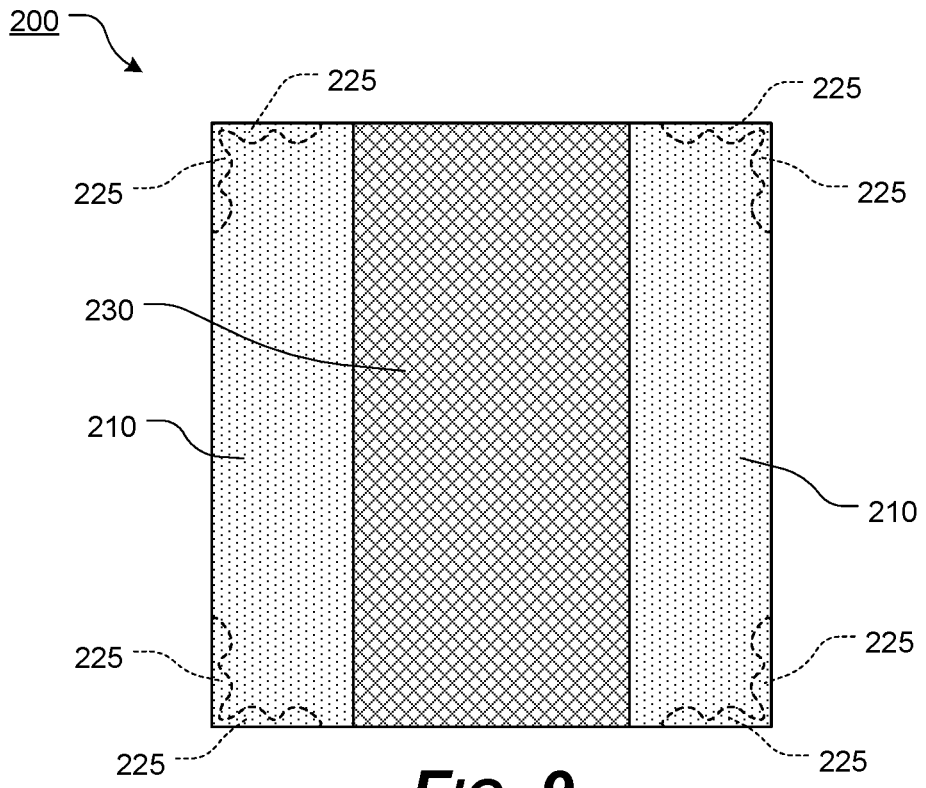
FIG. 9 illustrates a top view of an exemplary embodiment of a tray or endcap element, according to the present disclosure.
Figure 10:
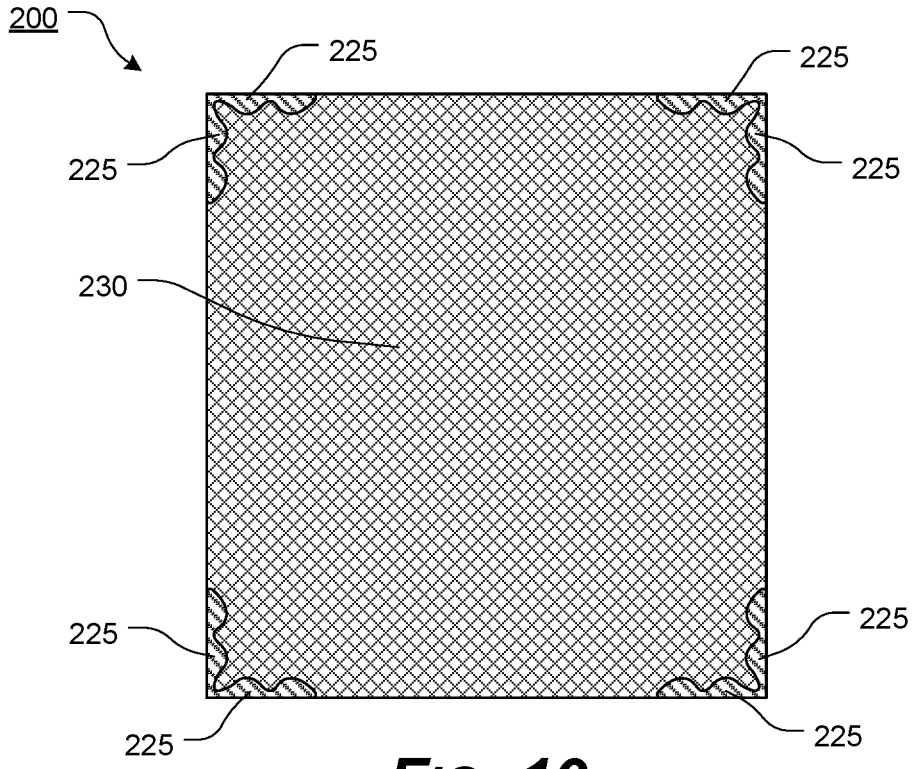
FIG. 10 illustrates a bottom view of an exemplary embodiment of a tray or endcap element, according to the present disclosure.
Figure 11:
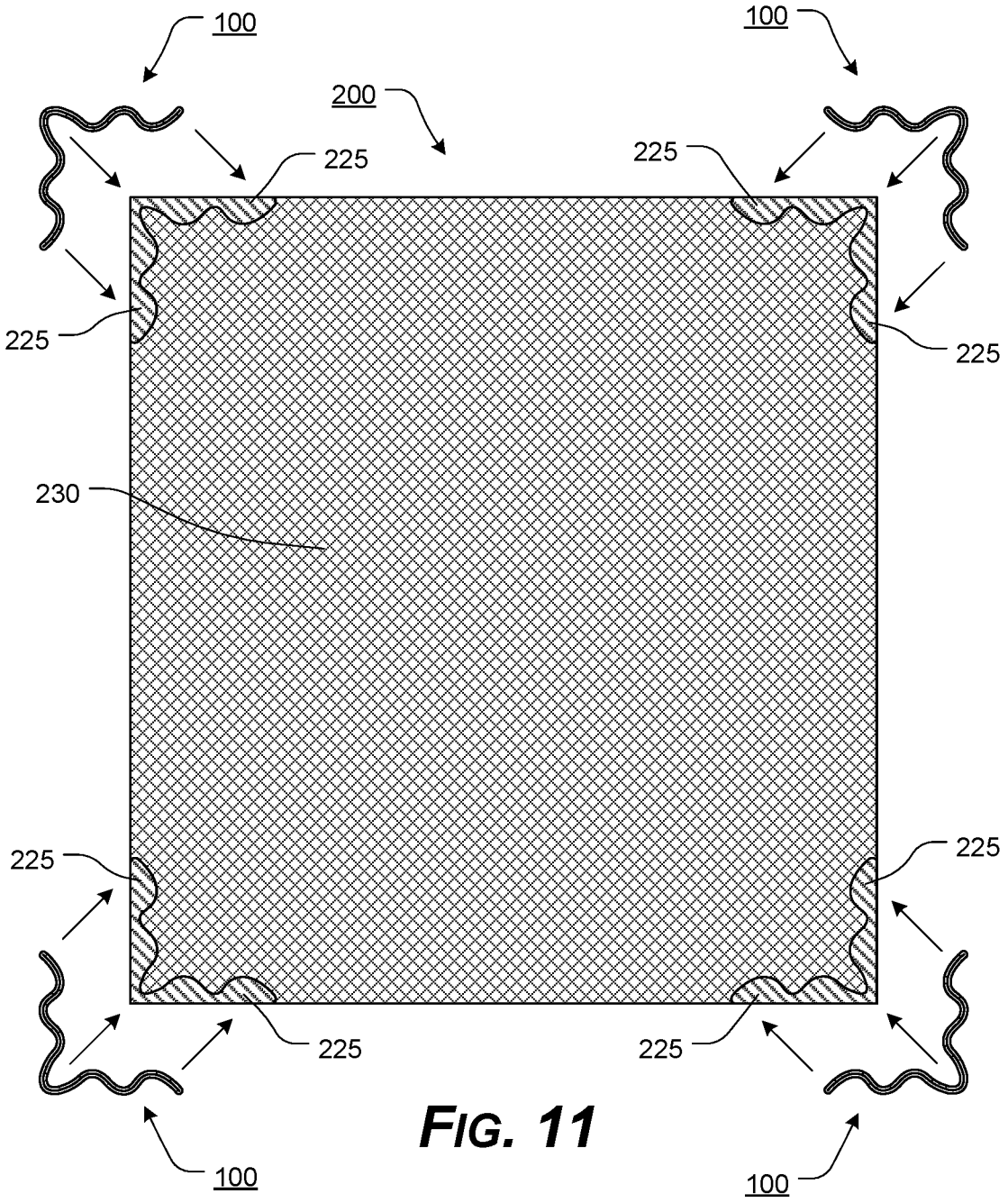
FIG. 11 illustrates a bottom view of exemplary embodiments of corrugated corner elements aligned with an exemplary embodiment of a tray or endcap element, according to the present disclosure.
Figure 12:
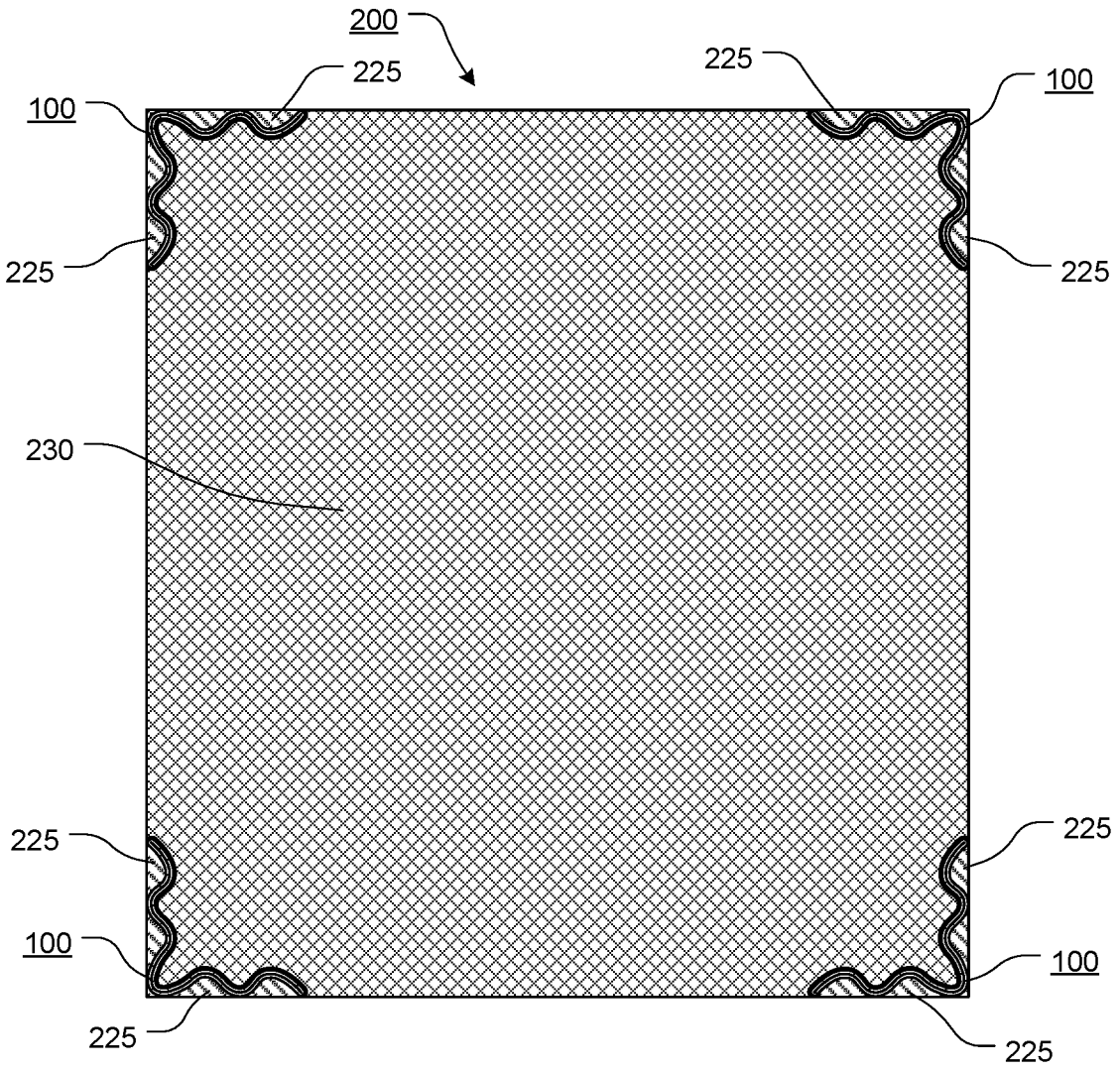
FIG. 12 illustrates a bottom view of exemplary embodiments of corrugated corner elements assembled with an exemplary embodiment of a tray or endcap element, according to the present disclosure.
Figure 13:
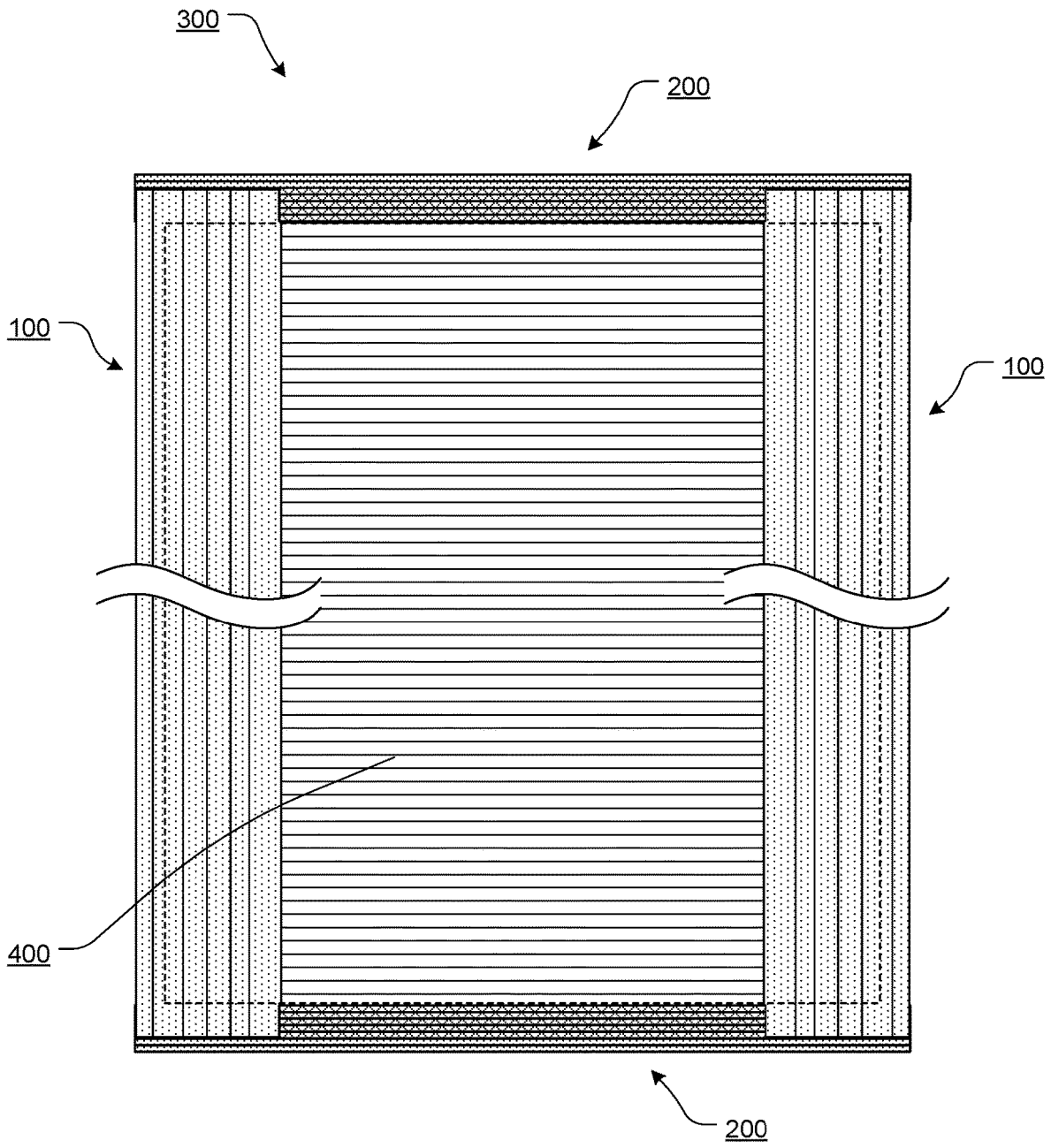
FIG. 13 illustrates a front view of exemplary embodiments of corrugated corner elements assembled with exemplary embodiments of tray or endcap elements, according to the present disclosure.
Figure 14:
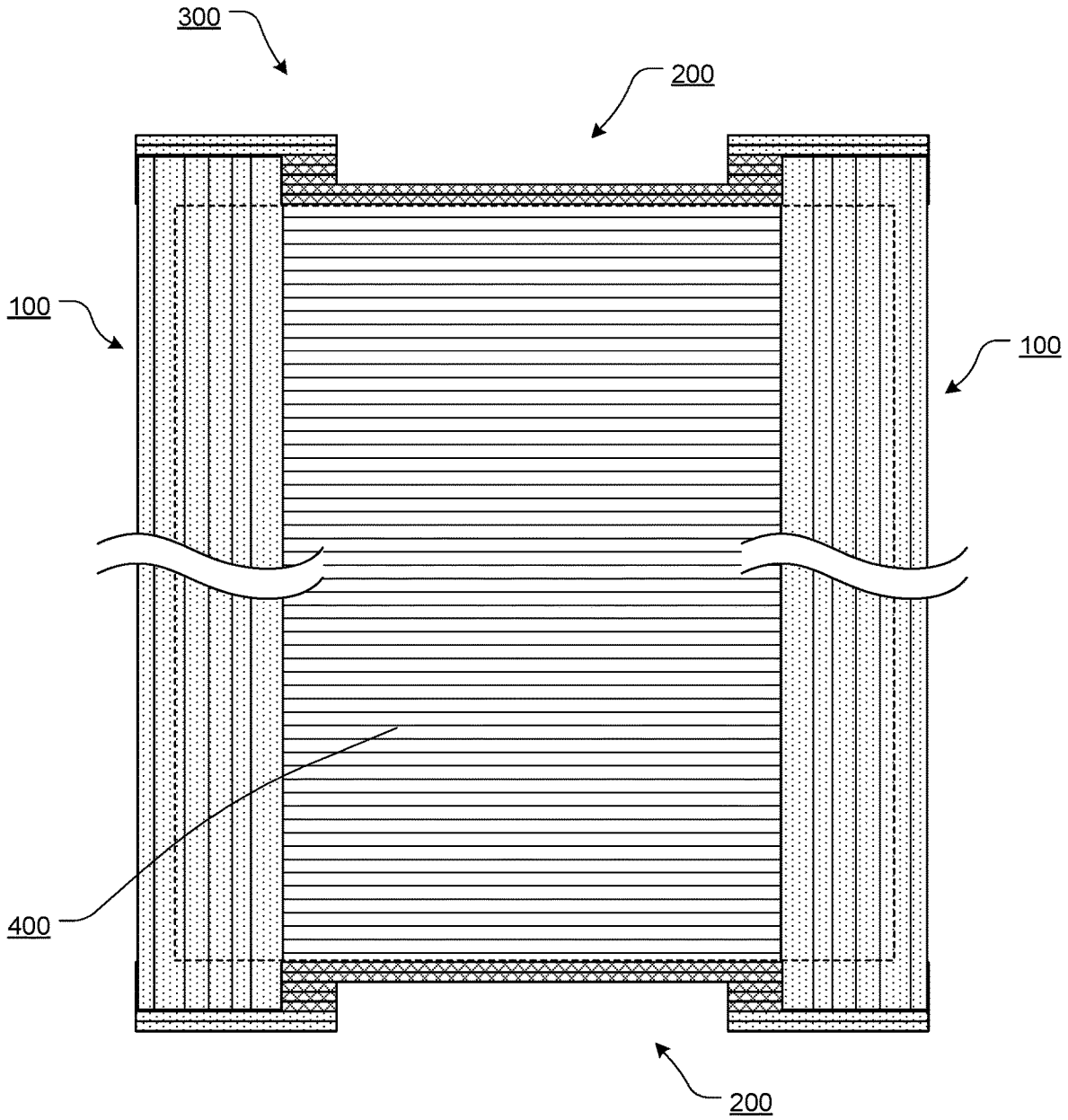
FIG. 14 illustrates a side view of exemplary embodiments of corrugated corner elements assembled with exemplary embodiments of tray or endcap elements, according to the present disclosure.

Typically, when viewed from the top or the bottom, as illustrated in FIGS. 4 and 5, respectively, the first corner post element leg 110 includes one or more alternating ridges 126 and grooves 124, formed along its length.

Likewise, the second corner post element leg 112 includes one or more alternating ridges 126 and/or grooves 124, along its length. Each of the alternating ridges 126 and grooves 124 of the first corner post element leg 110 extends, along or parallel to the longitudinal axis, $A_L$, of the corrugated corner elements 100. In certain exemplary, nonlimiting embodiments, each of the alternating ridges 126 and grooves 124 are parallel and alternating ridges 126 and grooves 124.

By including the alternating ridges 126 and grooves 124, the first corner post element leg 110 and the second corner post element leg 112 is curvilinear along its respective length, from the vertex 122 to the respective first corner post element end 128 and from the vertex 122 to the second corner post element end 129. The alternating ridges 126 and grooves 124 may be formed such that the first corner post element leg 110 and the second corner post element leg 112 each comprise a sinusoidal succession of waves or curves, along the respective lengths, from the vertex 122 to the respective first corner post element end 128 and from the vertex 122 to the second corner post element end 129.

As illustrated, a transverse cross-section of the second corner post element leg 112 forms a mirror image of a transverse cross-section of the first corner post element legs 110. However, it should be appreciated that it is not necessary for the transverse cross-section of the second corner post element leg 112 to form a mirror image of a transverse cross-section of the first corner post element legs 110. Thus, a transverse cross-section of the second corner post element leg 112 may have alternating ridges 126 and grooves 124 that are not mirror images of the alternating ridges 126 and grooves 124 of a transverse cross-section of the first corner post element legs 110.

An outer wall 120 forms an exterior surface of the corrugated corner post element 100, while an inner wall 130 forms and interior surface of the corrugated corner post element 100. As used herein, the terms "exterior" and "interior" are used for reference only and are not to be viewed as limiting the present disclosure. In certain exemplary, non-limiting embodiments, the outer wall 120 of the corrugated corner element 100 is substantially coextensive with the inner wall 130 of the corrugated corner element 100.

Because of the inclusion of the alternating ridges 126 and grooves 124, the corrugated corner post element 100 is even better able to resist top to bottom compression, parallel to the longitudinal axis, $A_L$, of the corrugated corner elements 100. Additionally, the inclusion of the alternating ridges 126 and grooves 124 help each of the first corner post element leg 110 and second corner post element leg 112 to better resist crushing, when forces are applied to the outer wall 120 and/or the inner wall 130.

At least to the vertex 122 and possibly the alternating ridges 126 and grooves 124 allow for a degree of inward flexion and resilient recovery toward the original shape of the first corner post element leg 110 relative to the second corner post element leg 112, as illustrated by the semicircular arrows in FIG. 4.

In various exemplary embodiments, the corrugated corner element 100 is substantially rigid and is formed of cardboard. Alternate materials of construction of the corrugated corner element 100 may include one or more of the following: thick paper (of various types), pasteboard, paperboard, container board, corrugated fiberboard, box board, or chipboard. In still other exemplary embodiments, alternate materials of construction of the corrugated corner element 100 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the corrugated corner element 100 is a design choice based on the desired appearance and functionality of the corrugated corner element 100 and/or the packaging assembly 300.

Generally, each endcap element 200 comprises at least one partial tray layer 210 and/or full tray layer 220 attached or coupled to at least one support layer 230. Each partial tray layer 210 includes an elongate portion of material having a top surface 211 and a bottom surface 212. Each full tray layer 220 includes an elongate portion of material having a top surface 221 and a bottom surface 222. Each support tray layer 230 includes an elongate portion of material having a top surface 231 and a bottom surface 232. However, it should be appreciated that each endcap element 200 may be formed or built up utilizing any number and/or combination of partial tray layers 210, full tray layers 220, and/or support layers 230.

In various exemplary embodiments, adjacent surfaces of the partial tray layer 210, full tray layer 220, and/or support layer 230 may optionally be bonded together, such as, by adhesives, forming adhesive layers 280. Alternatively, portions of the partial tray layer 210, full tray layer 220, and/or support layer 230 may optionally be attached, coupled, fastened, or secured to one another, mechanically (i.e., via nails, screws, rivets, pins, or other fasteners) or as otherwise known in the art.

In certain exemplary, nonlimiting embodiments, each full tray layer 220 extends to four corners. However, it should be understood that the number of corners of the full tray layer 220 is a design choice, dictated primarily by an upper or lower footprint of an article or product 400 that is to be contained or packaged within the packaging assembly 300.

It should also be appreciated that certain indents or recesses may be formed in at least portions of the partial tray layer 210, the full tray layer 220, and/or the support layer 230 to accommodate and/or further secure a packaged article or product 400 within the packaging assembly 300.

A corner recess 225 is formed in a portion of the at least one partial tray layer 210 and/or the at least one support layer 230. Each corner recess 225 is formed proximate each corner of the at least one partial tray layer 210 and/or full tray layer 220. In this manner, when the partial tray layer 210, the full tray layer 220 and/or the support layer 230 are attached or coupled to form the endcap element 200, corner portions of at least the partial tray layer 210 extend beyond the corner recesses 225 formed in the partial tray layers 210 and/or the support layers 230.

Each corner recess 225 is formed so as to mateingly engage at least a portion of the first end portion 101 or the second end portion 102 of one of the corrugated corner elements 100 at least partially therein. Each corner recess 225 forms a parallel curve or offset curve of the inner wall 130 of at least a first end portion 101 or a second end portion 102 of each of the corrugated corner elements 100 to form a mating surface for the inner wall 130 of at least a first end portion 101 or a second end portion 102 of each of the corrugated corner elements 100. Generally, each corner recess 225 is formed so as to substantially abut the inner wall 130 of at least a first end portion 101 or a second end portion 102 of each of the corrugated corner elements 100.

In various exemplary embodiments, one or more of the partial tray layer 210, the full tray layer 220 and/or the support layer 230 is substantially rigid and is formed of cardboard. Alternate materials of construction of the partial tray layer 210, the full tray layer 220 and/or the support layer 230 may include one or more of the following: thick paper (of various types), pasteboard, paperboard, container board, corrugated fiberboard, box board, or chipboard.

In still other exemplary embodiments, alternate materials of construction of the partial tray layer 210, the full tray layer 220 and/or the support layer 230 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the partial tray layer 210, the full tray layer 220 and/or the support layer 230 is a design choice based on the desired appearance and functionality of the partial tray layer 210, the full tray layer 220 and/or the support layer 230 and/or the packaging assembly 300.

FIGS. 11-14 illustrate the basic assembly of the packaging assembly 300. As illustrated most clearly in FIGS. 11-14, a first tray or endcap element 200 is positioned generally below an article or product 400. A second tray or endcap element 200 is positioned generally a top the article or product 400.

In certain exemplary, nonlimiting embodiments, the tray or endcap elements 200 may be constructed having an International Organization for Standardization (ISO) sanctioned pallet dimension (i.e., 40.00"×48.00", 39.37"×47.24", 45.9"×45.9", 42.00"×42.00", 43.30"×43.30", or 31.50"×47.24"), a Grocery Manufacturers' Association (GMA) pallet dimension (i.e., 40"×48", 42"×42", 48"×48", 48"×40", 48"×42", 40"×40", 48"×45", 44"×44", 36"×36", 48"×36", 35"×45.5", or 48"×20"), a European pallet dimension (i.e., 31.50"×47.24", 47.24"×39.37", 39.37"×47.24", 31.50"×23.62", 23.62"×15.75", or 15.75"×11.81"), an Australian pallet dimension (i.e., 45.87"×45.87"), or any desired size or shape. It should also be understood that the overall size and shape of the tray or endcap elements 200 (and the resulting packaging assembly 300), and the various portions thereof, is a design choice based upon the desired functionality, compatibility with desired articles or products, and/or appearance of the packaging assembly 300.

In certain exemplary, nonlimiting embodiments, at least a bottom surface of the first tray or endcap element 200 may be textured to provide a surface having a desired degree of friction relative to a floor or other support surface. Thus, the bottom surface of the first tray or endcap element 200 (or a top surface of the second tray or endcap element 200) may be chosen so as to allow the packaging assembly 300 to resist movement relative to a floor or other surface or more easily slide across a floor or other surface.

When properly positioned, a corner portion of at least the partial tray layer 210 extends beyond at least a portion of the article or product 400. In various exemplary embodiments, the corner recesses 225 are formed so as to generally allow the corrugated corner post elements 100 to be aligned with the corners of the partial tray layer 210.

The corner post elements 100 are sized so as to be positioned within the corner recesses of the spaced endcap elements 200. When positioned within the corresponding corner recesses 225. A terminal end of the second end portion 102 abuts against the corner portion of at least a partial tray layer 210 of a bottom or first tray or endcap element 200. Likewise, a terminal end of the first end portion 101 abuts against the corner portion of at least a partial tray layer 210 of a top or second tray or endcap element 200. In this manner, the terminal ends of the second end portions 102 of the corner post elements 100 are supported by the bottom or first tray or endcap element 200 and the terminal ends of the first end portions 101 will the corner post elements 100 support the top or second tray or endcap element 200. Thus, the packaged article or product 400 is maintained within the spaced endcap elements 200 and the corrugated corner post elements 100.

Each corner recess 225 is formed so as to mateingly engage at least a portion of the first end portion 101 or the second end portion 102 of one of the corrugated corner elements 100 at least partially therein. Each corner recess 225 forms a parallel curve or offset curve of the inner wall 130 of at least a first end portion 101 or a second end portion 102 of each of the corrugated corner elements 100 to form a mating surface for the inner wall 130 of at least a first end portion 101 or a second end portion 102 of each of the corrugated corner elements 100. Generally, each corner recess 225 is formed so as to substantially abut the inner wall 130 of at least a first end portion 101 or a second end portion 102 of each of the corrugated corner elements 100.

In various exemplary embodiments, opposing end portions of each corner recess 225 is formed so as to include a notch, groove, or other surface or surface preparation that allows at least a portion of the first corner post element end 128 and the second corner post element end 129 to be at least partially captured or frictionally engaged against the end portions of each corner recess 225. Thus, during installation, the corrugated corner elements 100 may be flexed inward, relative to the vertex 122, to be positioned within the respective corner recesses 225. Once appropriately positioned within the respective corner recesses 225, the natural resilience of the corrugated corner post element 100, causes the corrugated corner post element 100 to resiliently recover to or toward the original shape of the corrugated corner post element 100. This provides frictional or captured engagement of the corrugated corner post element 100 within the respective corner recess 225.

Once assembled, adjacent or abutted surfaces of the corner post elements 100 and tray or endcap elements 200 may optionally be bonded together, such as, by adhesives. Alternatively, portions of the corner post elements 100 and tray or endcap elements 200 may optionally be attached, coupled, fastened, secured, or bonded together, mechanically (i.e., vi, upon which a nails, screws, rivets, pins, or other fasteners) or as otherwise known in the art. In still other embodiments, the packaging assembly 300 may be wrapped in plastic or other material to further secure the corner post elements 100 to the tray or endcap elements 200.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A packaging assembly, comprising:

one or more corrugated corner elements, each of said corrugated corner elements extending continuously, along a longitudinal axis, from a first end portion to a second end portion, a vertex of each of said corrugated corner elements extending along said longitudinal axis;

each of said corrugated corner elements having a first corner post element leg, extending laterally from said vertex, said first corner post element leg having one or more alternating ridges and grooves, each of said alternating ridges and grooves of said first corner post element leg extending along said longitudinal axis of each of said corrugated corner elements;

each of said corrugated corner elements having a second corner post element leg, extending laterally from said vertex and away from said first corner post element leg, said second corner post element leg having one or more alternating ridges and grooves, each of said alternating ridges and grooves of said second corner post element leg extending along said longitudinal axis of each of said corrugated corner elements; and at least two spaced endcap elements, wherein each endcap element comprises at least one tray layer attached or coupled to at least one support layer, wherein said at least one tray layer extends to four corners, wherein said at least one support layer includes a corner recess formed proximate each corner of said at least one tray layer, and wherein each of said corrugated corner elements is formed so as to be at least partially flexed inwardly, relative to said vertex, to be positioned within a respective one of said corner recesses.

2. The packaging assembly of claim 1, wherein said vertex bisects each of said corrugated corner elements, along said longitudinal axis, proximate a center of each of said corrugated corner elements.

3. The packaging assembly of claim 1, wherein an outer wall of each of said corrugated corner elements is substantially coextensive with an inner wall of each of said corrugated corner elements.

4. The packaging assembly of claim 1, wherein each of said alternating ridges and grooves of said first corner post element leg are alternating ridges and grooves, parallel to said vertex.

5. The packaging assembly of claim 1, wherein each of said alternating ridges and grooves of said second corner post element leg are alternating ridges and grooves, parallel to said vertex.

6. The packaging assembly of claim 1, wherein each of said first corner post element legs and each of said second corner post element legs is curvilinear along a length.

7. The packaging assembly of claim 1, wherein an inner wall of each of said first corner post element legs and an inner wall of each of said second corner post element legs comprises a sinusoidal succession of waves or curves.

8. The packaging assembly of claim 1, wherein a transverse cross-section of each of said first corner post element legs forms a mirror image of a transverse cross-section of each of said second corner post element legs.

9. The packaging assembly of claim 1, wherein each corner recess is formed so as to substantially abut an inner wall of at least a first end portion or a second end portion of each of said corrugated corner elements.

10. The packaging assembly of claim 1, wherein each corner recess forms a parallel curve or offset curve of an inner wall of at least a first end portion or a second end portion of each of said corrugated corner elements.

11. The packaging assembly of claim 1, wherein each corner recess forms a mating surface for an inner wall of at least a first end portion or a second end portion of each of said corrugated corner elements.

12. A packaging assembly, comprising:

four corrugated corner elements, each of said corrugated corner elements having an outer wall and an opposing inner wall, each of said corrugated corner elements extending lengthwise, along a longitudinal axis, continuously from a first end portion to a second end portion, each of said corrugated corner elements having a first corner post element leg, said first corner post element leg having one or more alternating ridges and grooves, each of said alternating ridges and grooves extending along said longitudinal axis of each of said corrugated corner elements; each of said corrugated corner elements having a second corner post element leg, said second corner post element leg having one or more alternating ridges and grooves, each of said alternating ridges and grooves extending along said longitudinal axis of each of said corrugated corner elements, said first corner post element leg and said second corner post element leg each extending laterally from a vertex, said vertex extending along said longitudinal axis of each of said corrugated corner elements; and two spaced endcap elements, wherein each endcap element comprises at least one tray layer attached or coupled to at least one support layer, wherein said at least one tray layer extends to four corners, wherein said at least one support layer includes a corner recess formed proximate each corner of said at least one tray layer, and wherein each of said corrugated corner elements is formed so as to be at least partially flexed, relative to said vertex, to be positioned within a respective one of said corner recesses.

13. The packaging assembly of claim 12, wherein each of said alternating ridges and grooves of said first corner post element leg are alternating ridges and grooves, parallel to said vertex and wherein each of said alternating ridges and grooves of said second corner post element leg are alternating ridges and grooves, parallel to said vertex.

14. The packaging assembly of claim 12, wherein each of said first corner post element legs and each of said second corner post element legs is curvilinear along a length.

15. The packaging assembly of claim 12, wherein an inner wall of each of said first corner post element legs and an inner wall of each of said second corner post element legs comprises a sinusoidal succession of waves or curves.

16. The packaging assembly of claim 12, wherein a transverse cross-section of each of said first corner post element legs forms a mirror image of a transverse cross-section of each of said second corner post element legs.

17. The packaging assembly of claim 12, wherein each corner recess is formed so as to substantially abut said inner wall of at least a first end portion or a second end portion of each of said corrugated corner elements.

18. The packaging assembly of claim 12, wherein each corner recess forms a parallel curve or offset curve of said inner wall of at least a first end portion or a second end portion of each of said corrugated corner elements.

19. The packaging assembly of claim 12, wherein each corner recess forms a mating surface for said inner wall of at least a first end portion or a second end portion of each of said corrugated corner elements.

20. A packaging assembly, comprising:

one or more corrugated corner elements, each of said corrugated corner elements extending continuously, along a longitudinal axis, from a first end portion to a second end portion, a vertex of each of said corrugated corner elements extending along said longitudinal axis;

each of said corrugated corner elements having a first corner post element leg, extending laterally from said vertex, said first corner post element leg having one or more alternating ridges and grooves, each of said alternating ridges and grooves of said first corner post element leg extending along said longitudinal axis of each of said corrugated corner elements;

each of said corrugated corner elements having a second corner post element leg, extending laterally from said vertex and away from said first corner post element leg, said second corner post element leg having one or more alternating ridges and grooves, each of said alternating ridges and grooves of said second corner post element leg extending along said longitudinal axis of each of said corrugated corner elements; and two vertically spaced endcap elements, wherein each endcap element comprises a tray layer attached or coupled to a support layer, wherein said tray layer extends to four corners, wherein said support layer includes a corner recess formed proximate each corner of said tray layer, and wherein each of said corrugated corner elements is formed so as to be at least partially flexed, relative to said vertex, to be positioned within a respective one of said corner recesses.

* * * * *